US006171028B1

(12) United States Patent
Van Gelder

(10) Patent No.: US 6,171,028 B1
(45) Date of Patent: Jan. 9, 2001

(54) DEVICE AND METHOD FOR LIFTING A SEA-GOING STRUCTURE, FOR INSTANCE A DRILLING PLATFORM

(75) Inventor: Klaas Boudewijn Van Gelder, Delft (NL)

(73) Assignee: Allseas Group S.A. (CH)

( * ) Notice: Under 35 U.S.C. 154(b), the term of this patent shall be extended for 0 days.

(21) Appl. No.: 09/117,605

(22) PCT Filed: Dec. 3, 1997

(86) PCT No.: PCT/NL97/00663

§ 371 Date: Jan. 4, 1999

§ 102(e) Date: Jan. 4, 1999

(87) PCT Pub. No.: WO98/24980

PCT Pub. Date: Jun. 11, 1998

(30) Foreign Application Priority Data

Dec. 3, 1996 (NL) ..... 1004682

(51) Int. Cl.[7] ..... E02B 17/08
(52) U.S. Cl. ..... 405/209; 405/204
(58) Field of Search ..... 405/204, 209; 114/264, 265

(56) References Cited

U.S. PATENT DOCUMENTS 4,556,004 * 12/1985 Lamy et al. ..... 405/209 X
4,854,800 * 8/1989 Frick et al. ..... 414/138.2
5,037,241 * 8/1991 Vaughn et al. ..... 405/209
5,800,093 * 9/1998 Khachaturian ..... 405/204
5,829,919 * 11/1998 Heerema ..... 405/209

FOREIGN PATENT DOCUMENTS

2345280 * 3/1975 (DE) .

* cited by examiner

*Primary Examiner*—David Bagnell
*Assistant Examiner*—Sunil Singh
(74) *Attorney, Agent, or Firm*—Mark Zovko

(57) ABSTRACT

A device for lifting a sea-going structure (C), such as a drilling platform consisting of a superrstructure (B) and a jacket (J), which device consists of a flotation body (1) such as a boat provided with one or more laterally slidable lifting devices (2), wherein each lifting device (2) is provided with a coupling member (5) for fixing on a part of the substructure which is arranged for movement in all directions relative to the lifting device (2), whereby the device adapts better to the swell and the relative displacement of the flotation body (1) relative to the drilling platform.

7 Claims, 5 Drawing Sheets

Figure 1:
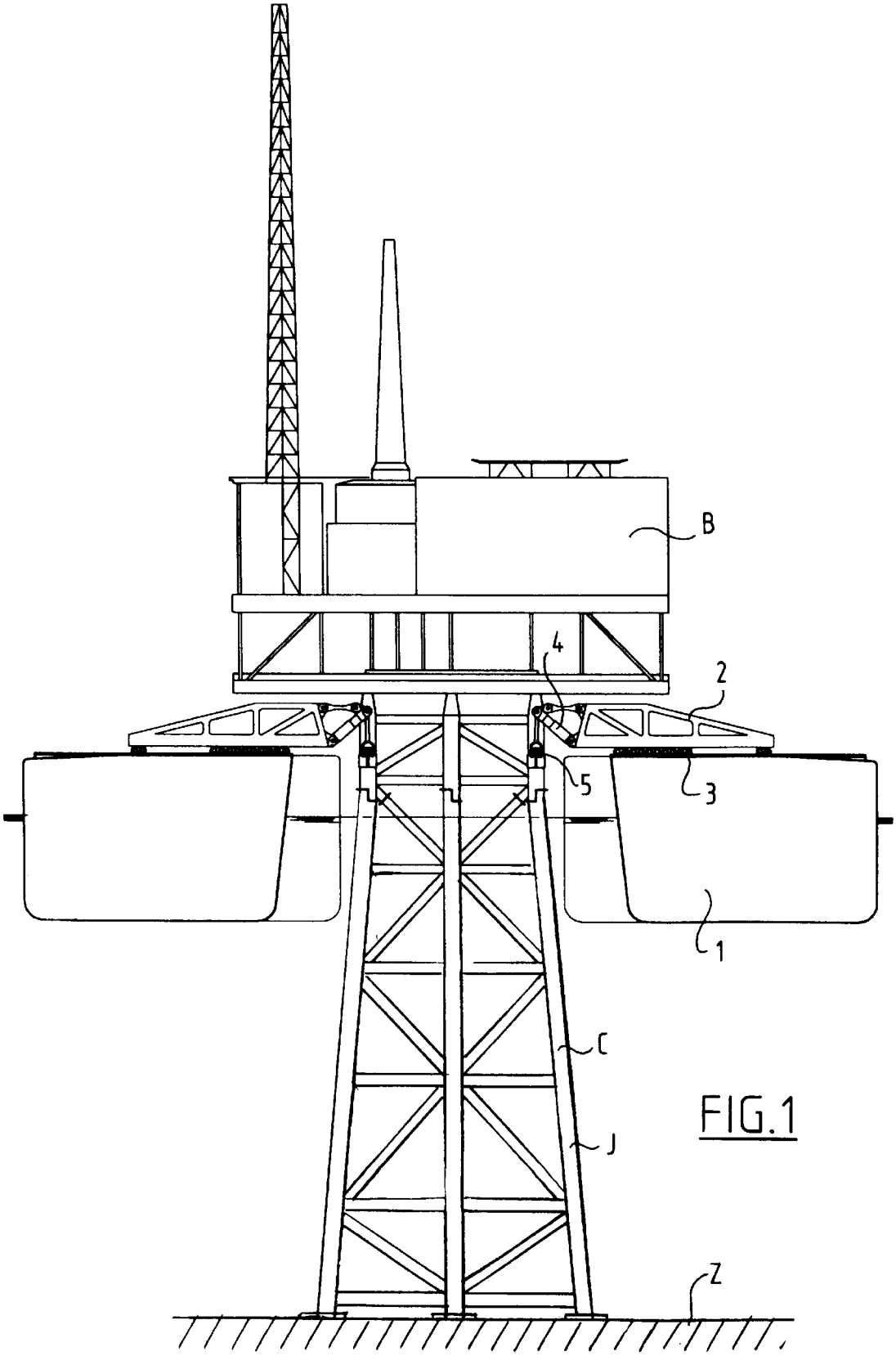

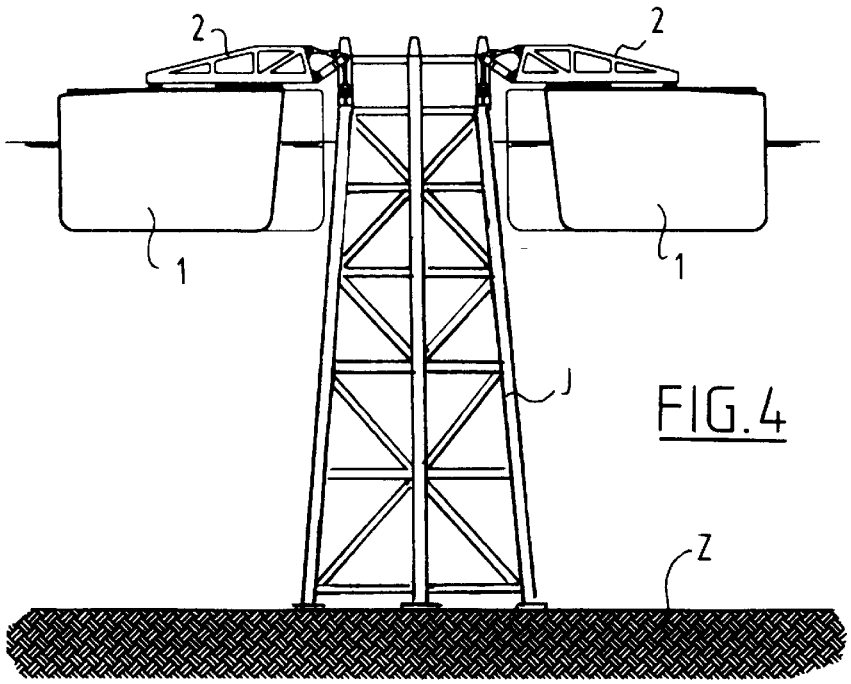
FIG.4
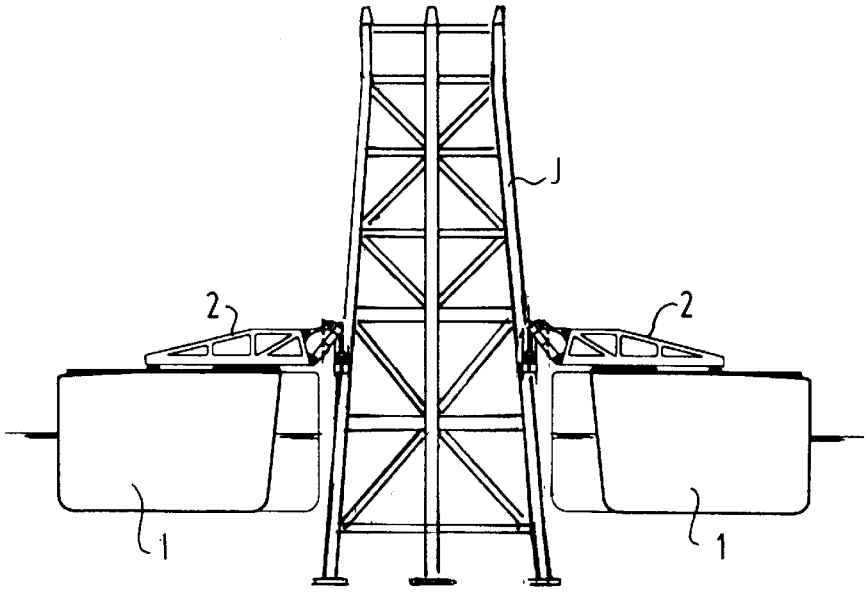
FIG.5
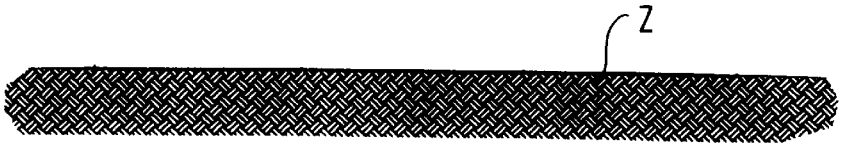

DEVICE AND METHOD FOR LIFTING A SEA-GOING STRUCTURE, FOR INSTANCE A DRILLING PLATFORM

The invention relates to a device for lifting a sea-going structure, such as a drilling platform consisting of a superstructure and a jacket, which device consists of a flotation body, such as a boat, provided with one or more laterally slidable lifting devices.

Accordingly to an earlier proposal by applicant, such a device is embodied with at least four or more jacks, each provided with a lifting device in order to enable raising of the superstructure after navigating the jacks under this superstructure. The drawback to such a jack is the poor adaptability to swell and the relative displacement of the flotation body or flotation bodies relative to the drilling platform. This can result in uncertainties.

The invention has for its object to provide a device wherein the above stated drawbacks are obviated and it provides for this purpose a device which is distinguished in that each lifting device is provided with a coupling member for fixing onto a part of the substructure which is arranged for movement in all directions relative to the lifting device.

A coupling member according to the invention is understood to mean that a positive connection takes place between the lifting means and the substructure of the sea-going structure, wherein the freedom of movement is ensured by the omnidirectional connection between the coupling member is preferably arranged at the bottom of a pendulum arm construction, which pendulum arm construction is suspended pivotally form the lifting device. A better stability of the already lifted part is thus ensured relative to the flotation bodies, which increases safety.

In the preferred embodiment the pendulum arm construction is embodied with two arms arranged at a mutual distance, the bottom ends of which are coupled to the coupling member on either side for pivoting thereon. This results in even better stability because the pendulum arms will automatically assume the optimum position relative to each other as a consequence of the reactive force generated by the weight of the lifted part of the sea-going structure.

If the substructure of the sea-going structure is assembled from tubes, it is recommended to embody the coupling member as a clamp, for instance a shell-like clamp which, if required, can close and open hydraulically.

The invention further relates to a method for lifting a sea-going body, wherein use is made of the above stated device. The method according to the invention is distinguished in that

- the flotation body is placed adjacently of the sea-going body,
- the coupling member of each lifting device under the superstructure is fixed to the substructure,
- the or each lifting cylinder of the lifting device is energized,
- the substructure elements such as the tubes are separated,
- the superstructure is lifted from the substructure and set down onto a transport vessel such as a pontoon.

The method can also be used to lift the remaining part of the sea-going structure, i.e. the substructure, once the superstructure has first been removed. This substructure has a considerable length and to this end the invention therefore proposes to fix the coupling member of each lifting device to the upper end part of the substructure,

- to lift the substructure,
- to release the coupling members successively in a predetermined sequence and fix them to a lower part of the substructure by relieving the lifting cylinder,

- to then energize the relevant lifting cylinder again in a predetermined sequence,
- to set down the raised substructure onto a transport vessel.

In this way any desired length of substructure can be gradually raised by causing the coupling members to engage repeatedly on a lower part of the substructure and subsequently moving them upward.

Figure 2:
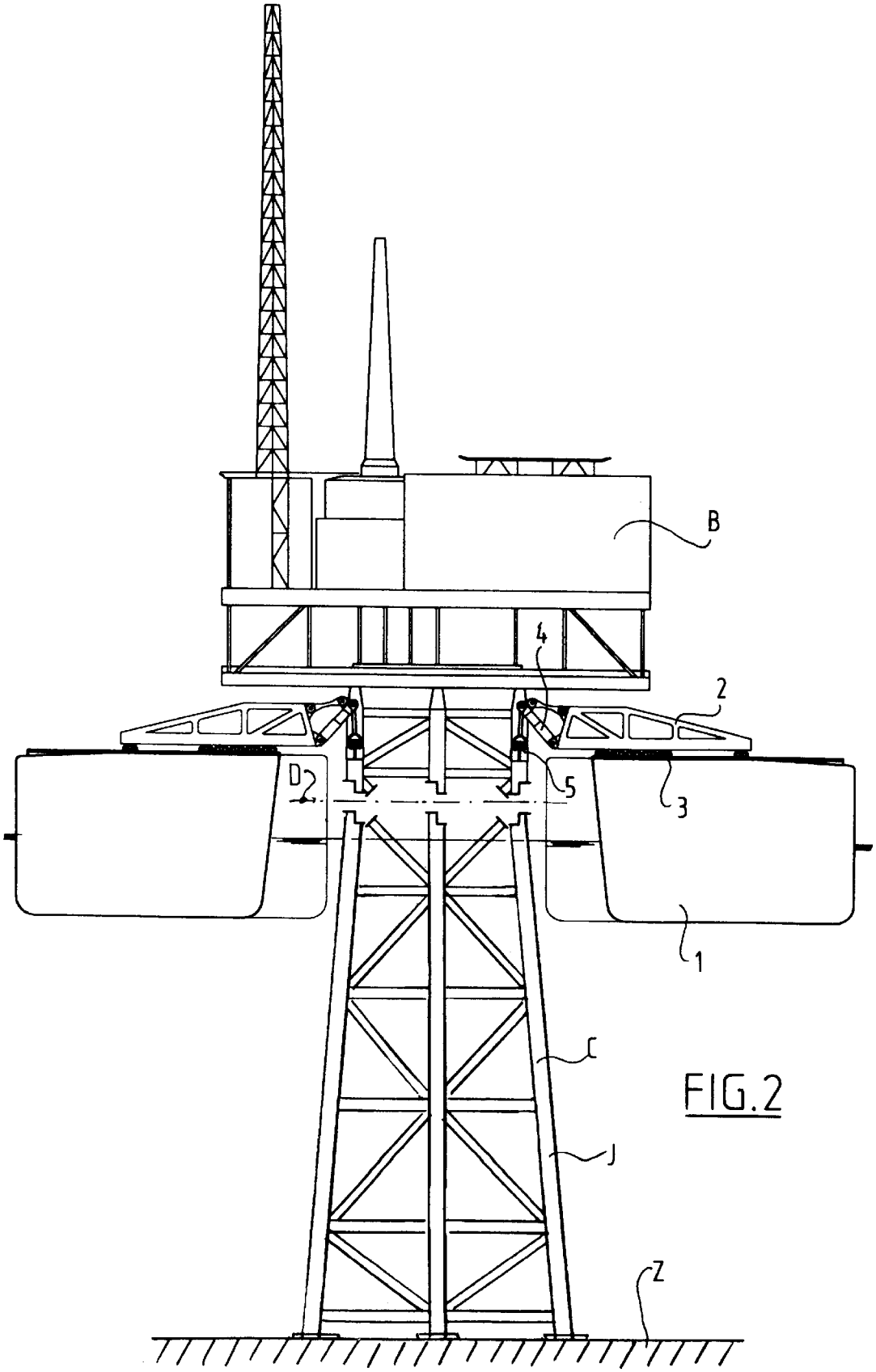
Figure 3:
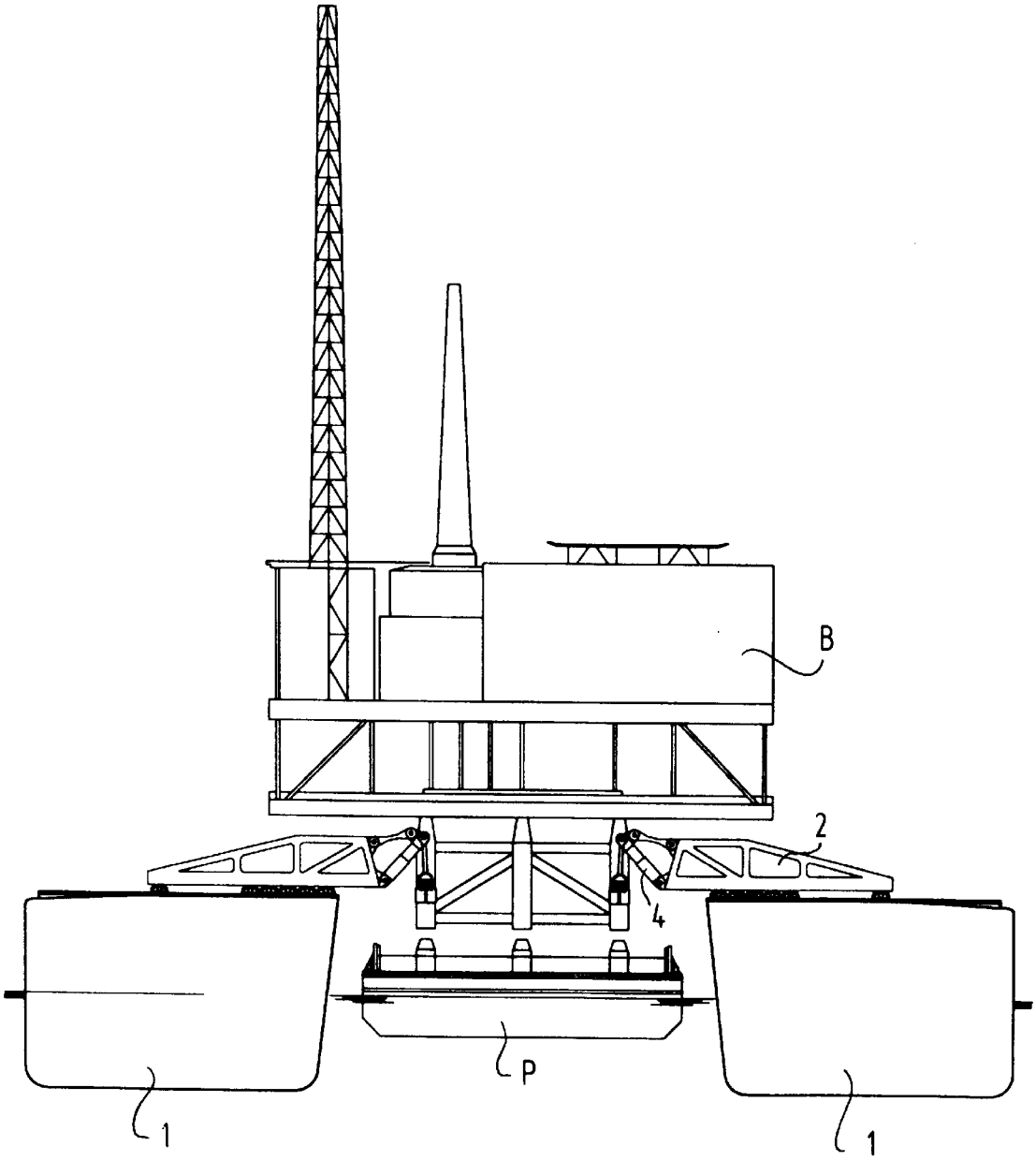

Above mentioned and other features of the device and method will be further elucidated in the figure description hereinbelow of an embodiment. In the drawing FIG. 1 shows a standing view of a sea-going structure which is placed on the seabed and wherein on either side thereof two flotation bodes, for instance boats provided with lifting devices, engage on the substructure, FIG. 2 shows a following step in the method during lifting of the superstructure, FIG. 3 shows the setting down of the lifted super-structure onto a pontoon, FIGS. 4 and 5 show a side view corresponding with FIG. 1 and 2 of the device applied during lifting of the substructure, FIGS. 6*a, b* and *c* show a side view of the pendulum arm construction applied in the device of FIG. 1 in three different height positions, FIG. 7 shows a side view corresponding with FIG. 6 of the pendulum arm construction with a different position of the pendulum arm, FIGS. 8*a* and *b* show a front view of the pendulum arm construction in two different positions.

In FIGS. 1–5 is shown that a sea-going structure C standing on the seabed Z can be removed with a device embodied with a flotation body 1 on which is placed a lifting device 2. Flotation body 1 can take any random form and is for instance a self-propelled boat, for instance a decommissioned oil tanker. Lifting device 2 is of random nature and can slide over a guide 3 in sideways direction relative to the longitudinal axis of boat 1. On the end facing the outside of the boat is arranged a lifting mechanism 4 which will be described further. The lifting mechanism is embodied according to the invention with a coupling member 5 which can be fixed to any of the tubes of the sea-going structure.

The sea-going structure is embodied with a superstructure B and a substructure or jacket J.

The whole structure must be removed from the seabed Z and for this purpose the structure is separated into parts and carried away.

In the shown embodiment of FIG. 1, the flotation bodies 1 are arranged on either side with the associated lifting means.

After fixing of the coupling members 5 the tube construction of jacket J can separated at the planes of section D, whereafter superstructure B is carried upward by energizing lifting cylinders 4 simultaneously with draining of ballast liquid out of the flotation bodies 1, see FIG. 2.

After navigating away from jacket J, a pontoon P can be guided between the flotation bodies 1 as according to FIG 3, and superstructure B can be set down with a portion of the substructure onto pontoon P by relieving lifting cylinders 4.

Flotation bodies 1 are then re-placed on either side of the remaining jacket part and the coupling members can be fixed at a random position along the vertical tube parts. By once again energizing lifting cylinders 4 the jacket is raised from the seabed Z and, by subsequently releasing the coupling members 5 one by one and re-arranging them at a lower position along the tubular standing parts of the jacket, this latter can be carried upward each time through a determined height, for instance in steps of three metres or the like, as shown in FIG. 5.

Raising of the jacket can go so far that the underside can be carried above a pontoon P and set down thereon. In the case of a very high jacket it is recommended to separate the bottom part in each case from the part of the device suspended in the coupling members, whereafter the top part can be dropped onto the pontoon. This procedure can take place repeatedly until the jacket has been reduced in height such that it can be carried away safely on pontoon P.

There now follows a description of the coupling members suspended in a pendulum construction according to the invention which is fixed to lifting device 2.

FIGS. 6*a* through 6*c* and FIGS. 8*a* and 8*b* show the coupling member 5 in the form of a clamp consisting of two half-shell parts 10, 11 which can close onto each other in randon manner, for instance by hydraulic cylinders (not shown) or in other manner by means of a bolt connection. The clamping force is sufficient to prevent shifting in vertical direction along the tubes of the structure C. If desired, a collar can be welded round the tube (not shown) at the top of the clamp in order to avoid the above mentioned shifting.

One of the shell parts 10 or 11 of the clam is provided with ears 12, each of which is embodied with a ball joint 13 to which the bottom end of a pendulum arm 14 is coupled.

The upper end of each pendulum arm 14 is likewise provided with a ball joint 15 which is received in a fork-like end part 16 of lifting cylinder 4. The fork-like end part 16 is itself provided with a coupling plate 17 for receiving the upper end hinge part 18 of a coupling rod 19. The coupling rod is connected pivotally at 20 to lifting device 2. The other end of lifting cylinder 4 is likewise connected pivotally to the lifting device at 21.

Figure 6A:
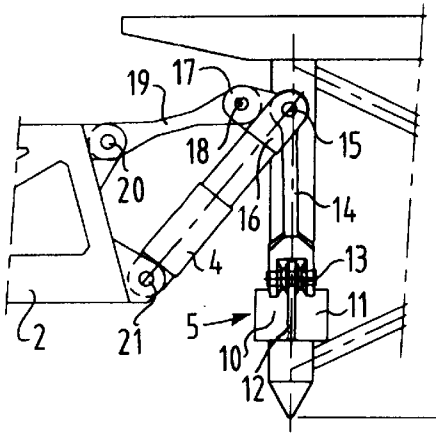

FIGS. 6*a, b, c* show divers height positions which can be reached by relieving or energizing the lifting cylinder 4. FIG. 6*a* shows the highest position, wherein coupling rod 19 has an upward directed position and wherein the pendulum arm 14 moves to the left compared to the middle position according to FIG. 6*b*. The low position is shown in FIG. 6*c*. The difference in height between the positions 6*a* and 6*c* can be for instance three metres.

Figure 6B:
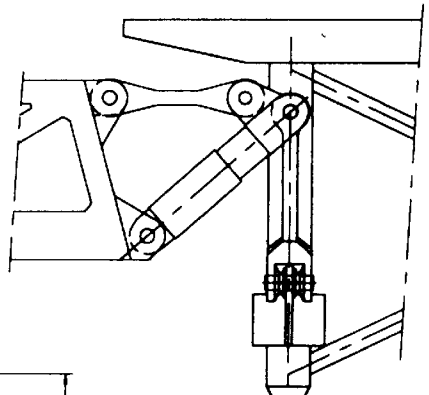
Figure 6C:
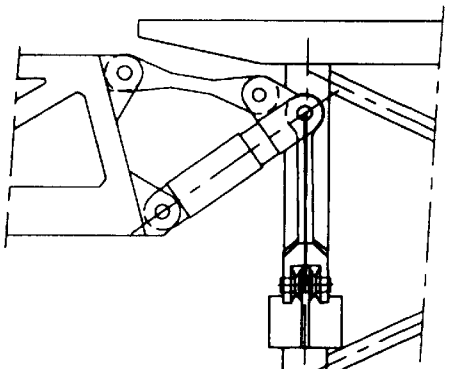
Figure 7:
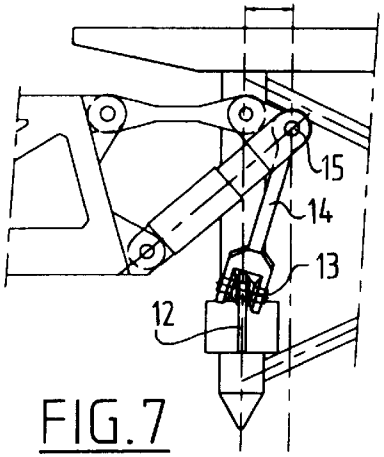

FIG. 7 shows a position which starts from the middle position, FIG. 6*b*, but wherein the flotation body 1 is shifted relative to the structure, C such that pendulum arm 14 will take up a position clearly moving to the right.

This position is possible without problem due to the ball joints 13 respectively 15. An outward moving position of pendulum arm 14 is of course also possible.

Figure 8A:
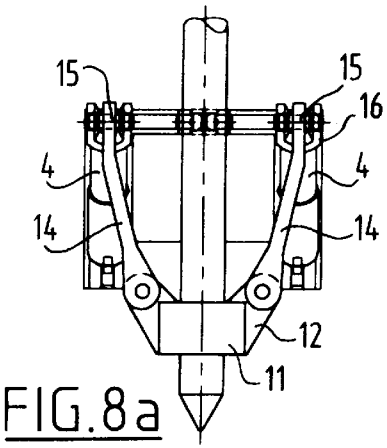
Figure 8B:
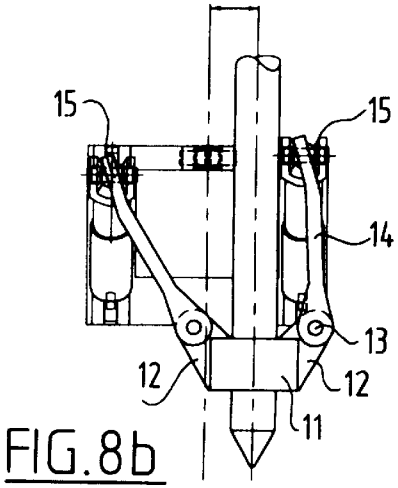

FIGS. 8*a* and 8*b* show a position wherein both cylinders 4 assume the same position and wherein the pendulum arms 14 lie symmetrically relative to the axis of the tube of structure C. A difference can be seen in FIG. 8*b*, wherein tube C has shifted to the right relative to cylinders 4, this being possible because the cylinders are extended to a greater or lesser degree and wherein the ball joints 15 allow pivoting of pendulum arms 14. Here also, considerable movements are possible in the order of magnitude of two metres.

It will be apparent form the foregoing that due to the flexible suspension of coupling member 5 relative to flotation bodies 1 the stability of the raised part is increased. Relevant here is the self-correcting design of the pendulum arm construction, since the four clamping members engaging on the corner posts of the jacket C automatically adjust to the most favourable position as a result of the force of gravity. The flotation bodies 1 are also set into the correct position relative to the structure as a result of the force of gravity. Possible variations resulting from the influences of the swell on flotation bodies 1 can be overcome easily.

The invention is not limited to the above described embodiment.

The coupling members 5 can be embodied in any suitable manner, for instance as elements which are welded fixedly to the tubes of structure C. What is essential herein is the mobility in all directions of pendulum arms 14 as a result of ball joints 13 respectively 15.

The lifting device 2 can likewise be embodied in random manner, wherein more than one lifting cylinder 4 can be envisaged.

What is claimed is:

1. A device for lifting a sea-going structure comprising a superstructure and a substructure, wherein said device comprises a floatation body, provided with one or more laterally slidable lifting devices, characterized in that each lifting device is provided with a pendulum arm construction having a coupling member for fixing onto a part of the substructure, said pendulum are construction is suspended pivotally from the lifting device.

2. The device as claimed in claim 1, characterized in that the pendulum arm construction is embodied with two arms arranged at a mutual distance, the bottom ends of which are coupled to the coupling member on either side for pivoting thereon.

3. Device as claimed in claim 2, characterized in that the upper end of each pendulum arm is coupled for pivoting in all directions to a lifting cylinder of the lifting device.

4. Device as claimed in claim 1, wherein said substructure is assembled form tubes, characterized in that the coupling member is embodied as a clamp for placing around one of said tubes of said substructure.

5. A method for lifting a sea-going body, said se-going body comprising a superstructure and a substructure with a device which comprises a flotation body provided with one or more laterally slidable lifting devices having lifting cylinders each lifting device is provided with a pendulum arm construction having a coupling member for fixing on to a part of the substructure, said pendulum arm construction being suspended pivotally from the lifting device which includes a) placing the flotation body adjacent to said sea-going body;

b) fixing said coupling member of each lifting device under said superstructure to said substructure;

c) energizing each lifting cylinder of said lifting device;

d) separating the superstructure from at least part of the substructure;

e) lifting the superstructure from at least a part of the substructure;

f) setting the superstructure onto a transport vessel.

6. The method as claimed in claim 5, which further includes a) fixing the coupling member of each lifting device to the upper end part of the substructure;

b) lifting the substructure;

c) releasing the coupling members successively in a predetermined sequence and fixing said coupling members onto a lower part of the substructure by relieving the lifting cylinder;

d) energizing the relevant lifting cylinders are then energized again in a predetermined sequence;

e) setting the raised substructure down onto a transport vessel.

7. Method as claimed in claim 6, characterized in that after the substructure has been set down onto the vessel, separating the substructure into at least an upper and lower part to facilitate transport.

* * * * *